US009784457B2

(12) United States Patent
Oh et al.

(10) Patent No.: US 9,784,457 B2
(45) Date of Patent: Oct. 10, 2017

(54) OVEN, DOOR ASSEMBLY APPLIED TO THE SAME, AND METHOD FOR CONTROLLING THE OVEN

(71) Applicant: Samsung Electronics Co., Ltd., Suwon-si (KR)

(72) Inventors: Dong Jin Oh, Yongin-si (KR); Dong Ho Lee, Suwon-si (KR); Hye Rin Kim, Seoul (KR); Sang Hyun Yeo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 121 days.

(21) Appl. No.: 14/806,945

(22) Filed: Jul. 23, 2015

(65) Prior Publication Data

US 2016/0033142 A1 Feb. 4, 2016

(30) Foreign Application Priority Data

Aug. 1, 2014 (KR) ..... 10-2014-0098898
Sep. 2, 2014 (KR) ..... 10-2014-0116071

(51) Int. Cl.
*F24C 15/02* (2006.01)
*F24C 15/00* (2006.01)
*F24C 15/04* (2006.01)

(52) U.S. Cl.
CPC ..... *F24C 15/006* (2013.01); *F24C 15/02* (2013.01); *F24C 15/028* (2013.01); *F24C 15/04* (2013.01)

(58) Field of Classification Search
CPC ..... F24C 15/006
USPC ..... 126/198, 200
See application file for complete search history.

(56) References Cited

U.S. PATENT DOCUMENTS 3,450,126 A * 6/1969 Vonderhaar ..... F24C 15/04 126/200
3,717,138 A * 2/1973 Upp ..... F24C 15/04 126/200
4,023,554 A * 5/1977 Katona ..... F24C 15/04 126/198

(Continued)

FOREIGN PATENT DOCUMENTS

DE 44 07 084 A1 9/1995
EP 0 490 774 A1 6/1992

(Continued)

OTHER PUBLICATIONS

European Office Action dated Aug. 25, 2016 in European Patent Application No. 15179350.2.

(Continued)

*Primary Examiner* — Avinash Savani
(74) *Attorney, Agent, or Firm* — Staas & Halsey LLP

(57) ABSTRACT

A display device is provided. The display device includes a transparent display panel; and an optical switching element arranged on the transparent display panel and configured to be switched into any of transmissive state, non-transmissive state, and reflective state, wherein the optical switching element includes a non-transmission layer formed to contact the transparent display panel and switched into transmissive state or non-transmissive state, and a reflection layer formed on one side of the non-transmission layer and switched into transmissive state or reflective state.

20 Claims, 17 Drawing Sheets

(56) References Cited

U.S. PATENT DOCUMENTS

| | | | | |
|---|---|---|---|---|
| 4,206,338 | A * | 6/1980 | Katona | F24C 15/04 126/200 |
| 5,387,258 | A * | 2/1995 | Puricelli | F24C 15/04 126/198 |
| 2006/0219234 | A1* | 10/2006 | Larsen | F24C 15/04 126/198 |
| 2006/0237425 | A1 | 10/2006 | Kim et al. | |
| 2007/0125760 | A1 | 6/2007 | Kim et al. | |
| 2008/0105140 | A1 | 5/2008 | Lee et al. | |
| 2011/0214661 | A1 | 9/2011 | Hyun et al. | |
| 2016/0033143 | A1* | 2/2016 | Lee | F23M 5/00 126/198 |

FOREIGN PATENT DOCUMENTS

| | | | |
|---|---|---|---|
| EP | 0 947 776 | A2 | 10/1999 |
| EP | 1566594 | | 8/2005 |
| EP | 1793174 | | 6/2007 |
| EP | 2 108 892 | A1 | 10/2009 |
| GB | 2 013 872 | A | 8/1979 |
| KR | 10-2006-0104751 | | 10/2006 |
| KR | 1020090085982 | A | 8/2009 |

OTHER PUBLICATIONS

Partial European Search Report dated Nov. 25, 2015 from European Patent Application No. 15179350.2, 6 pages.
Extended European Search Report dated Jan. 27, 2016 in European Patent Application No. 15178933.6.
U.S. Appl. No. 14/808,102, filed Jul. 24, 2015, Dong Ho Lee et al., Samsung Electronics Co., Ltd.
European Office Action dated Feb. 27, 2017 for European Patent Application No. 15179350.2.

* cited by examiner

OVEN, DOOR ASSEMBLY APPLIED TO THE SAME, AND METHOD FOR CONTROLLING THE OVEN

CROSS-REFERENCE TO RELATED APPLICATIONS

This application claims the priority benefit from Korean Patent Application No. 10-2014-0098898, filed on Aug. 1, 2014 in the Korean Intellectual Property Office and Korean Patent Application No. 10-2014-0116071 filed on Sep. 2, 2014 in the Korean Intellectual Property Office, the entire disclosures of which are incorporated by reference.

BACKGROUND

1. Field

The present disclosure relates to an oven with an improved cooling structure of the door to open/close a cooking room.

2. Description of the Related Art

Ovens are cooking appliances used for cooking a substance by sealing up and heating the substance, and may be generally classified by their heat-source into electric, gas, and microwave ovens. Electric ovens use electric heaters as heat sources, and gas and microwave ovens use heat from gas and frictional heat of water molecules at high frequencies as heat sources, respectively.

The oven includes a cooking room for cooking, and a machine room for containing electrical and mechanical components. In the process of cooking, the cooking room is shut tight to prevent the internal high temperature heat from seeping out. Inside the tightly shut cooking room, foreign materials like grease are made during a process of cooking, and some of the foreign materials are stuck to the inside wall of the cooking room.

Ovens equipped with various cleaning systems have been developed to remove the foreign materials remaining inside the cooking room. One of the various cleaning systems uses a method for removing the foreign materials stuck to the inside wall of the cooking room and the inner side of the front door by using high temperatures inside the cooking room. This type of oven generates heat of 400~500° C. inside the cooking room to remove the foreign materials stuck to the inside wall of the shut cooking room and the inner side of the front door.

The oven has a structure capable of insulation and cooling to prevent high temperatures inside the cooking room from being delivered to outer sides of the oven. The door of the oven in particular serves to drop the temperature of the outer side of the door by enabling circulation of outdoor air into the inner space. The outdoor air flowing into the inner space of the door, however, affects not only the temperature of the outer side of the door but also the temperature of the inner side.

SUMMARY

In an aspect of one or more embodiments, the present disclosure provides an oven and its door assembly with an improved structure to efficiently clean the inner wall of the cooking room and the inner side of the door by using high temperatures inside the cooking room.

In an aspect of one or more embodiments, the present disclosure provides an oven and its door assembly with an improved structure to cool off the outer side of the door while keeping the inner side of the door at the same temperature of the inner wall of the cooking room.

The present disclosure also provides an oven and method for controlling the same, by which information regarding operation of a heat source is visualized on the outer side of the oven.

In accordance with an aspect of the present disclosure, an oven is provided. The oven includes a casing; a cooking room located inside the casing and having an open front; and a door assembly mounted to the cooking room to open and close the open front of the cooking room, wherein the door assembly has an inner space and the door assembly includes a rear plate and a front plate to form the inner space of the door assembly, a first inner plate installed in the inner space to divide the inner space; and a shielding member located between the first inner plate and the rear plate of the door assembly to block air circulation between the first inner plate and the rear plate.

The first inner plate may be arranged in a position to face the rear plate of the door assembly, and a distance between the first inner plate and the rear plate of the door assembly may be narrower than a distance between the first inner plate and the front plate of the door assembly.

The door assembly may further include a second inner plate located between the first inner plate and the front plate of the door assembly to divide a space between the first inner plate and the front plate of the door assembly, wherein a distance between the first inner plate and the second inner plate may be wider than a distance between the first inner plate and the rear plate of the door assembly.

The distance between the first inner plate and the rear plate of the door assembly may be narrower than a distance between the second inner plate and the front plate of the door assembly.

The front plate, the rear plate, the first inner plate and the second inner plate of the door assembly may each have at least a part formed of a glass of a transparent material.

The shielding member may be arranged to extend along a bottom of the first inner plate to block outdoor air from flowing between the first inner plate and the rear plate of the door assembly.

The shielding member may be arranged in a form of surrounding edges of a space formed between the first inner plate and the rear plate of the door assembly.

The shielding member may extend along both sides of the first inner plate and the bottom of the inner plate.

The door assembly may have an open bottom and a flow-out hole arranged on one side of a top of the door assembly.

The oven may further include a cooling fan unit including a cooling fan located between the casing and a top of the cooking room; and a cooling fan fluid path that runs from the cooling fan to a front of the oven, wherein the flow-out hole may be arranged in a position to face the cooling fan fluid path.

In accordance with aspect of the present disclosure, an oven having a heat cleaning mode for cleaning an inner wall of a cooking room and an inner side of a door assembly facing the cooking room by using high temperatures is provided. The oven may include a casing; a cooking room located inside the casing and having an open front; and a door assembly having at least one fluid path formed therein and the door assembly mounted to the cooking room to open and close the open front of the cooking room, wherein the door assembly may include a rear plate, a first fluid path formed along the rear plate of the door assembly to provide a space; and a shielding member installed inside the first fluid path for blocking air circulation in the first fluid path. The oven may further include a second fluid path which is formed separately from the first fluid path and which provides a space for air circulation. The first fluid path may be separated from the second fluid path by a first inner plate.

The first fluid path may have a first width which is narrower than a second width of the second fluid path.

The shielding member may be located on a lower side of the first fluid path for shielding the first fluid path.

The shielding member may have a rectangular shape to shield the top, bottom, and both sides of the first fluid path.

The door assembly may further include a front plate and a third fluid path which is formed along the front plate of the door assembly and which is formed separately from the second fluid path in order to provide a space for air circulation from the bottom toward the top, wherein the third fluid path may have a third width which is wider than the first width of the first fluid path.

The door assembly may further include a second inner plate positioned between the first inner plate and the front plate for forming the second and third fluid paths. The first inner plate may form the first fluid path with the rear plate of the door assembly. The first inner plate may form the second fluid path with the second inner plate, and the second inner plate may form the third fluid path with the front plate.

The front plate, the rear plate, the first inner plate and the second inner plate of the door assembly may each have at least a part formed of a glass of a transparent material.

The door assembly may enable air flowing into an inside of the door assembly through a bottom flow-in unit to move outside of the door assembly through a flow-out hole formed on one side of a top of the door assembly.

The oven may further include a cooling fan unit including a cooling fan located between the casing and a top of the cooking room; and a cooling fan fluid path that runs from the cooling fan to a front of the oven, wherein the flow-out hole may be arranged in a position to face the cooling fan fluid path.

In accordance with an aspect of the present disclosure, a door assembly having an inner space and serving to open and close a cooking room of an oven is provided. The door assembly may include a first inner plate positioned in the inner space to face a rear plate of the door assembly and to divide the inner space; and a shielding member located between the first inner plate and the rear plate of the door assembly to block air circulation.

A distance between the first inner plate and the rear plate of the door assembly may be narrower than a distance between the first inner plate and a front plate of the door assembly.

The door assembly may further include a second inner plate located between the first inner plate and the front plate of the door assembly to divide a space between the first inner plate and the front plate of the door assembly, wherein a distance between the first inner plate and the second inner plate may be wider than a distance between the first inner plate and the rear plate of the door assembly.

The shielding member may be positioned to extend along the bottom of the first inner plate to block outdoor air from flowing between the first inner plate and the rear plate of the door assembly.

The shielding member may be arranged in a form of surrounding edges of a space formed between the first inner plate and the rear plate of the door assembly.

A distance between the second inner plate and the front plate of the door assembly may be wider than the distance between the first inner plate and the rear plate of the door assembly.

A distance between the first inner plate and a second inner plate may be wider than the distance between the second inner plate and the front plate of the door assembly.

In an aspect of the present disclosure, an oven is provided. The oven includes a casing; a cooking room located inside the casing; and a display located on the outside of the casing for displaying an operation of a heat source as a predetermined graphic image or displaying temperatures of the cooking room as colors of the graphic image.

The display may display thermal diffusion in the cooking room due to operation of the heat source as graphic images.

The display may display an operation of the heat source at least one of a cooking mode and a cleaning mode as a predetermined graphic image.

The heat source may include multiple heat sources, and the graphic image may include multiple graphic images that correspond to the multiple heat sources.

The heat source may include at least one of a convection fan installed in the back of the cooking room, and a heating source installed on the top or bottom of the cooking room.

The display may display a change in temperature in the cooking room due to operation of the heat source as a change in color of the graphic image.

The display may be installed in front of the cavity.

In an aspect of the present disclosure, a method for controlling the oven is provided. The method includes displaying an operation of a heat source as a predetermined graphic image, and displaying temperatures of a cooking room as colors of the graphic image.

Displaying an operation of a heat source as a predetermined graphic image may include displaying thermal diffusion in the cooking room due to operation of the heat source as graphic images.

Displaying an operation of a heat source as a predetermined graphic image may include displaying an operation of the heat source in at least one of a cooking mode and a cleaning mode as a predetermined graphic image.

The heat source may include multiple heat sources, and the graphic image may include multiple graphic images that correspond to the multiple heat sources.

Displaying temperatures of a cooking room as colors of the graphic image may include displaying a change in temperature in the cooking room as a change in color of the graphic image.

Other aspects, advantages, and salient features of the disclosure will become apparent to those skilled in the art from the following detailed description, which, taken in conjunction with the annexed drawings, discloses exemplary embodiments of the disclosure.

BRIEF DESCRIPTION OF THE DRAWINGS

The above and other features and advantages of the present disclosure will become more apparent by describing in detail exemplary embodiments thereof with reference to the attached drawings in which.

Throughout the drawings, like reference numerals will be understood to refer to like parts, components, and structures.

DETAILED DESCRIPTION

Figure 1:
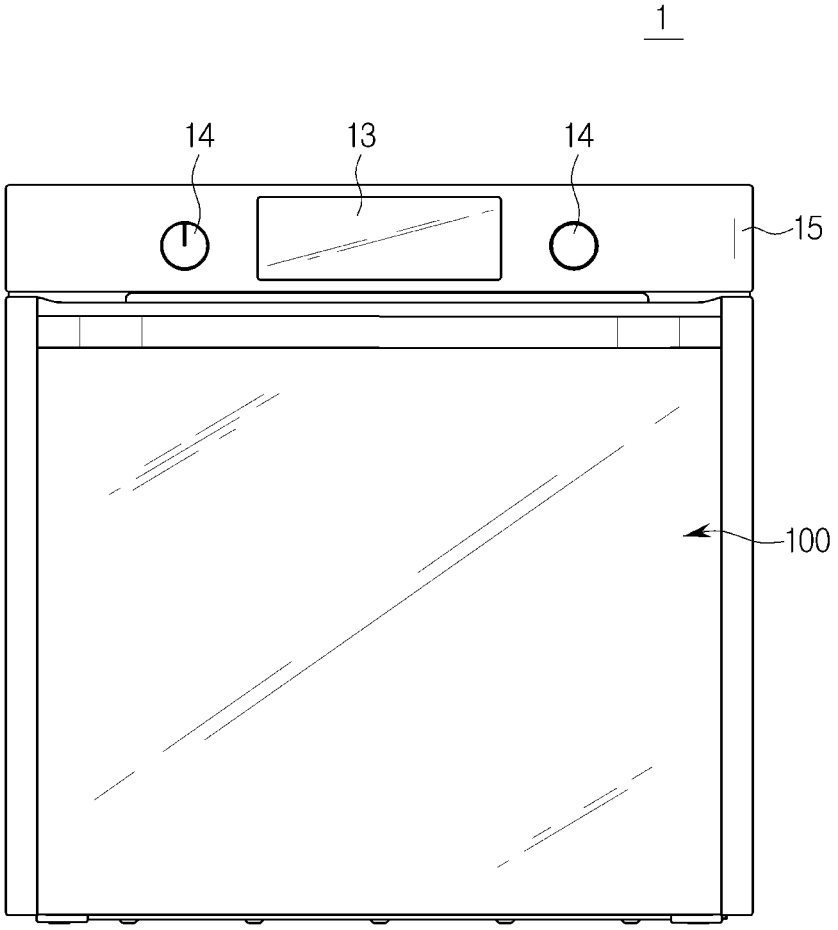
FIG. 1 is a front view of an oven, according to an embodiment of the present disclosure.

Reference will now be made in detail to embodiments, examples of which are illustrated in the accompanying drawings, wherein like reference numerals refer to the like elements throughout.

Figure 2:
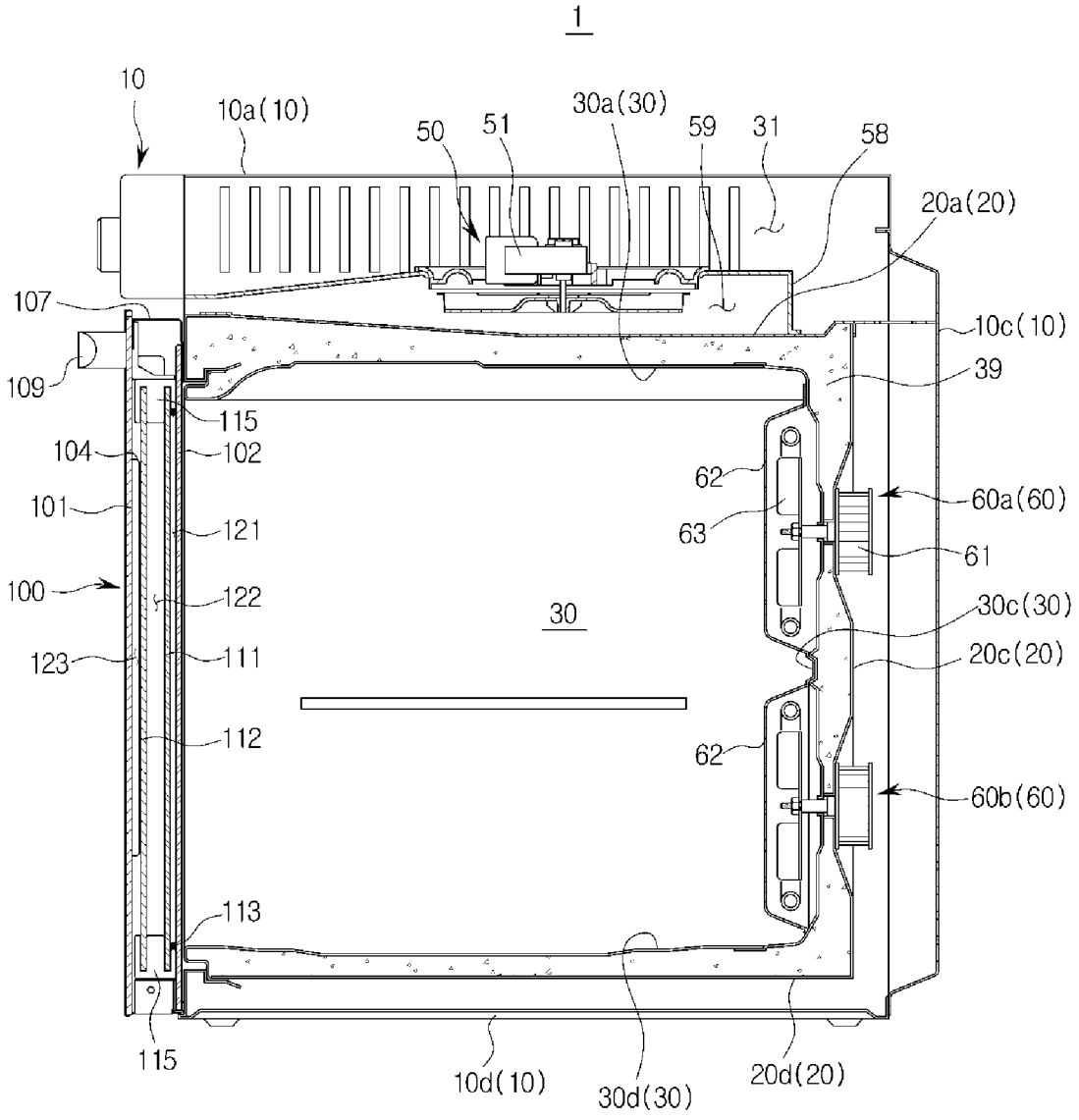
FIG. 2 is a side cross-sectional view of an oven, according to an embodiment of the present disclosure.

FIG. 1 is a front view of an oven, according to an embodiment of the present disclosure, and FIG. 2 is a side cross-sectional view of an oven, according to an embodiment of the present disclosure.

As shown in FIGS. 1 and 2, an oven 1 may include a casing 10 that forms the exterior shape, and a cooking room 30 located inside the casing 10.

The casing 10 may include a side casing 10*b* (of FIG. 3) formed on both sides of the oven 1, a rear casing 10*c* formed in the back, a top casing 10*a* formed on the top, and a bottom casing 10*d* combined to the bottom floor. A hole (not shown) may be formed in at least a part of the casing 10 to make outdoor air flow into the casing 10.

The cooking room 30 may have the form of a box comprised of a cooking room top plate 30*a* forming the top, two cooking room side plates (not shown) forming the both sides, a cooking room back plate (30*c*) forming the back, and a cooking room bottom plate 30*d* forming the bottom. The cooking room 30 may be formed to have an open front for putting in or taking out a cooking substance.

A machine room 31 containing various mechanical and electrical parts such as circuit boards (not shown) is arranged on top of the cooking room 30. A control panel 15 for controlling the machine room 31 may include a display 13 for displaying various operation information of the oven 1, and a controlling unit 14 for controlling operation of the oven 1.

In addition, a rack (not shown) to place a cooking substance thereon may be equipped inside the cooking room 30, and a plurality of supporters (not shown) may be arranged to install the rack. The supporters may be arranged to protrude from left and right side walls of the cooking room 30.

At least one circulation fan unit 60 may be combined onto the cooking room back plate 30*c* of the cooking room 30. In an embodiment of the present disclosure, two circulation fan units 60 are combined onto the cooking room back plate 30*c* of the cooking room 30. Each circulation fan unit 60 may include a circulation motor 61 and a circulation fan 63. A circulation fan cover 62 formed of flat-typed members may cover the circulation fan 63. One or more through holes (not shown) may be formed on the circulation fan cover 62. With the through holes, a fluid that passed by the circulation fan 63 may move into the cooking room 30 through the through holes.

A cooling fan unit 50 may be installed in the machine room 31 to cool off the inside of the machine room 31. The cooling fan unit 50 may suck outdoor air into the machine room 31 and then discharge the air forward of the oven 1.

The cooling fan unit 50 may include a cooling fan 51, and a cooling fan housing 58 combined onto the top of the top panel 20*a*. The cooling fan 51 may be combined on a side of the cooling fan housing 58, and move the air inside the machine room 31 to the inside of the cooling fan housing 58. A cooling fan fluid path 59 may be arranged inside the cooling fan housing 58. The cooling fan fluid path 59 may be formed to run from the cooling fan 51 to the front face of the oven 1. The cooling fan fluid path 59 may be formed to have an open front to discharge the air inside the cooling fan housing 58.

The cooking room 30 and the cooling fan unit 50 may be connected to each other via a separate fluid path (not shown). During the process of cooking, at least a part of a fluid of the cooking room 30 may flow into the cooling fan unit 60 through the fluid path and then be discharged forward of the oven 1.

A panel 20 may be situated between the casing 10 and the cooking room 30. The panel 20 may be positioned to be spaced apart from the casing 10. This may enable a fluid path for air flow to be formed between the casing 10 and the panel 20.

The panel 20 may be comprised of a back panel 20*c* arranged to face the cooking room back plate 30*c*, side panels (not shown) arranged to face the cooking room side plates (not shown), and a top panel 20*a* arranged to face the cooking room top plate 30*a*. At least one slit (not shown) may be formed on at least a part of the panel 20, which enables the air to be moved over the outer surface of the panel 20.

Insulation 39 may be arranged between the cooking room 30 and the panel 20. Specifically, the insulation 39 may be filled between the cooking room top plate 30*a* and the top panel 20*a*, the cooking room back plate 30*c* and the back panel 20*c*, the cooking room side plates and the side panels (not shown), and the cooking room bottom plate 30*d* and a bottom panel 20*d*. The insulation 39 may prevent heat inside the cooking room 30 from being delivered to the machine room 31 and to the outside of the oven 1.

The open front of the cooking room 30 may be open or closed by a door assembly 100. The door assembly 100 may be hinged to the cooking room 30 to be able to rotate upward or downward.

The oven 1 in accordance with an embodiment of the present disclosure may include a heat cleaning mode for cleaning the inner wall of the cooking room 30 and the inner side of the door assembly 100 facing the cooking room 30 by using high temperatures inside the cooking room 30. The door assembly 100 having an improved structure to improve the efficiency of the heat cleaning mode will now be described in detail in accordance with embodiments of the present disclosure.

Figure 3:
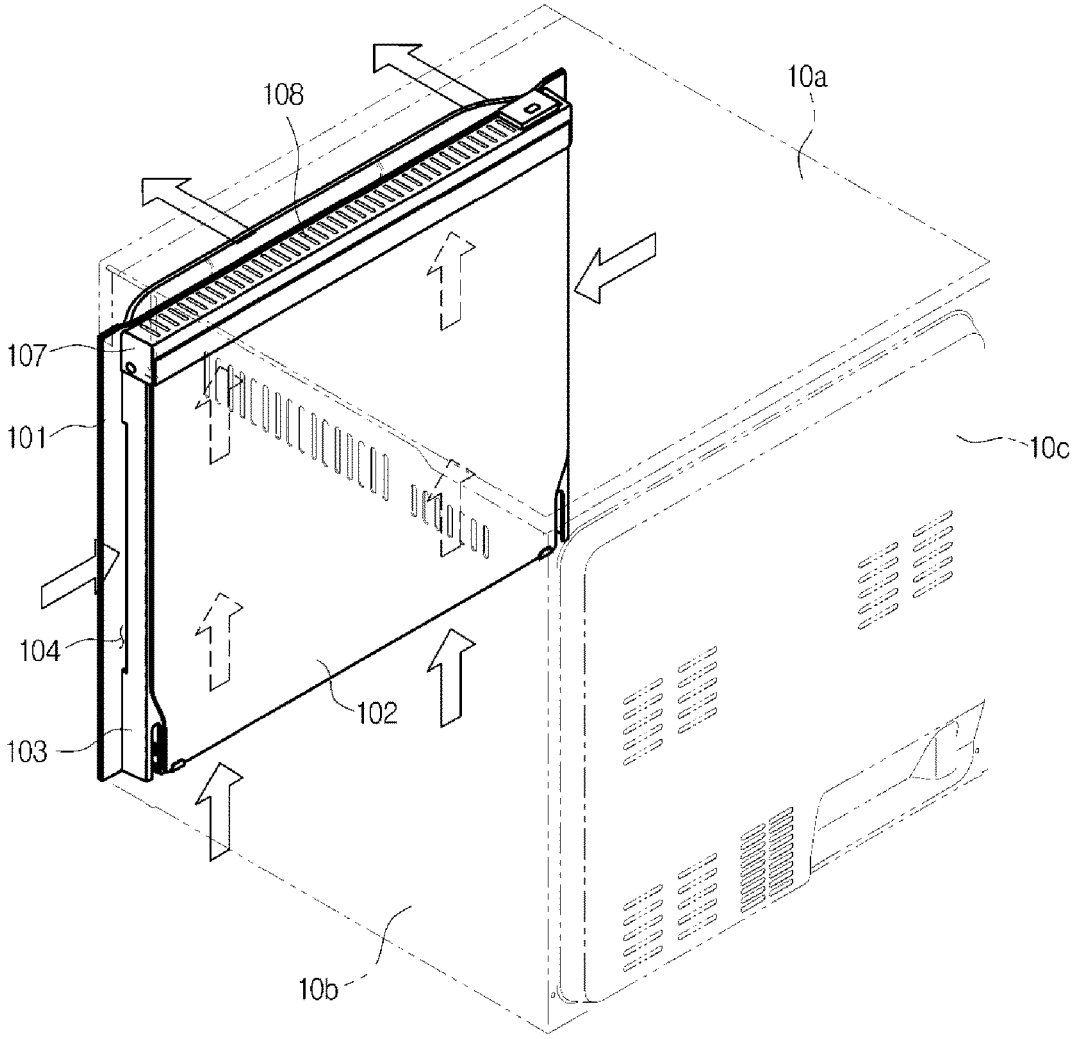
FIG. 3 is a perspective view of a rear side of a door assembly, according to an embodiment of the present disclosure.
Figure 4:
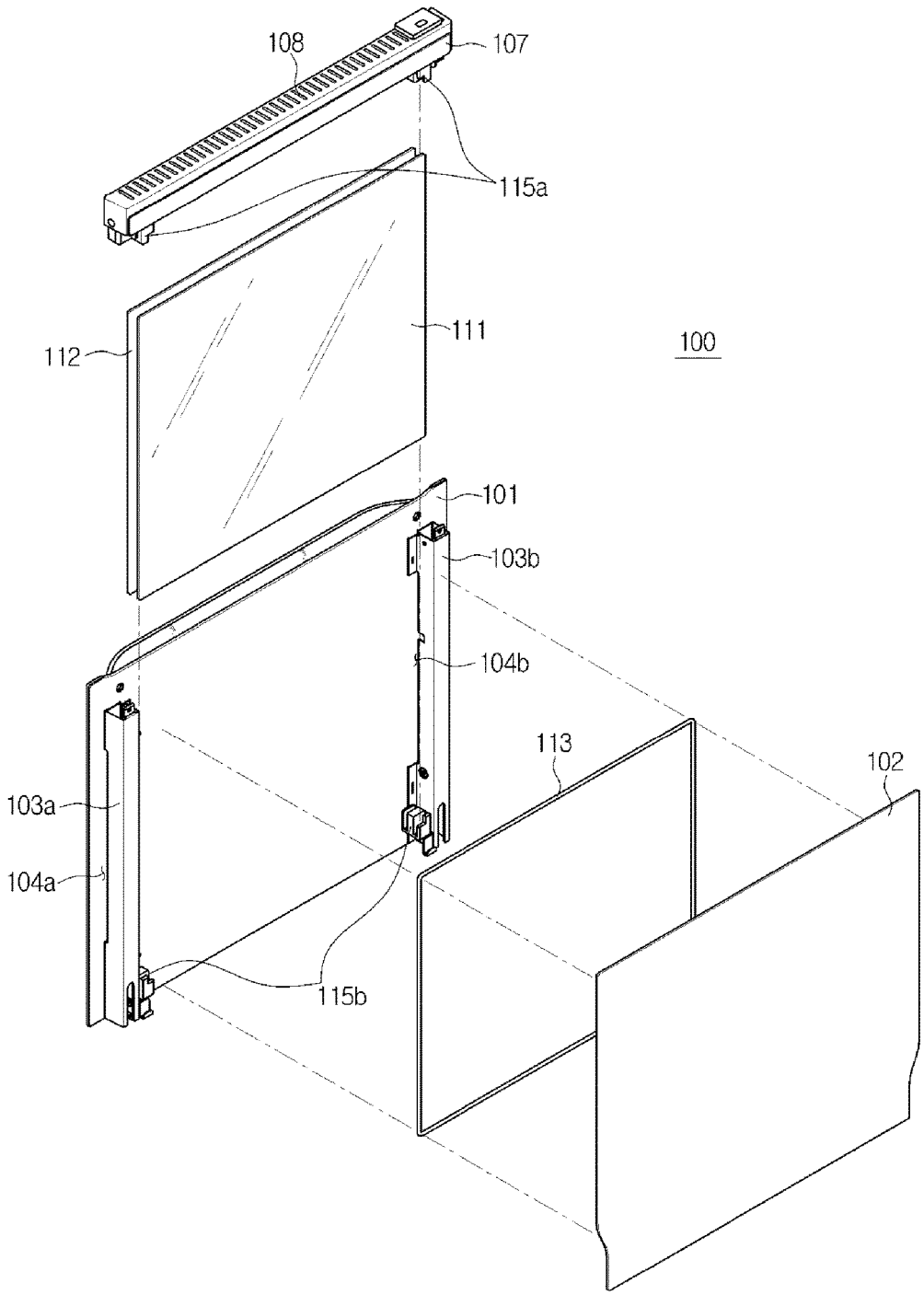
FIG. 4 is an exploded view of a structure of a door assembly, according to an embodiment of the present disclosure.

FIG. 3 is a perspective view of a rear side of a door assembly, according to an embodiment of the present disclosure, and FIG. 4 is an exploded view of a structure of a door assembly, according to an embodiment of the present disclosure.

Referring to FIGS. 2 to 4, the door assembly 100 in accordance with an embodiment of the present disclosure may include a front plate 101, a rear plate 102, and a side frame 103.

The front plate 101 may be provided on the front side of the door assembly 100. At least a part of the front plate 101 may include a transparent material, such as glass.

The rear plate 102 may be provided on the rear side of the door assembly 100. The rear plate 102 may be arranged a certain distance apart back from the front plate 101. The rear plate 102 and the front plate 101 may form an inner space of the door assembly 100. At least a part of the rear plate 102 may include a transparent material, such as glass.

The side frame 103 may be arranged on both sides of the inner space formed between the front plate 101 and the rear plate 102. The side frame 103 may be combined with the front plate 101 and the rear plate 102, such that the rear plate 101 is fixedly installed a distance apart back from the front plate 101.

The side frame 103 may include a first side frame 103*a* and a second side frame 103*b*. The first side frame 103*a* and the second side frame 103*b* may be installed to face each other on the left and right sides, respectively, between the front plate 101 and the rear plate 102.

The side frame 103 may further include a side flow-in unit 104. The side flow-in unit 104 may serve as a passage for outdoor air to flow into the inner space of the door assembly 100 through the side frame 103. For example, the side flow-in unit 104 may be formed on the front of the side frame 103. The side flow-in unit 104 may be formed to extend along the front plate 101 upward or downward from a point at which the front plate 101 and the side frame 103 come into contact. Accordingly, outdoor air may flow in to the front of the inner space through the side flow-in unit 104 of the door assembly 100.

The side flow-in unit 104 may include a first side flow-in unit 104*a* formed on the first side frame 103*a*, and a second side flow-in unit 104*b* formed on the second side frame 103*b*. The first and second side flow-in units 104*a* and 104*b* may be formed to face each other.

The door assembly 100 may further include a top cover 107. The top cover 107 may be situated on the top of the door assembly 100. The top cover 107 may be combined with the respective tops of the front plate 101, the rear plate 102, and the side frame 103, thus covering the top of the inner space of the door assembly 100.

A flow-out hole 108 may be formed on at least a side of the top cover 107. For example, the flow-out hole 108 may be formed on the top of the top cover 107. There may be a plurality of flow-out holes 108 formed on the top of the top cover 107 at regular intervals. Alternatively, the flow-out hole 108 may be formed on the rear side of the top cover 107.

For example, the flow-out hole 108 may be formed on a location to face the cooling fan fluid path 59. The flow-out hole 108 may serve as a passage for heated air inside the door assembly 100 to flow out of the oven 1. The air passing through the flow-out hole 108 and moving upward of the door assembly 100 may be released out of the oven 1 with the air discharged from the cooling fan fluid path 59.

Figure 5:
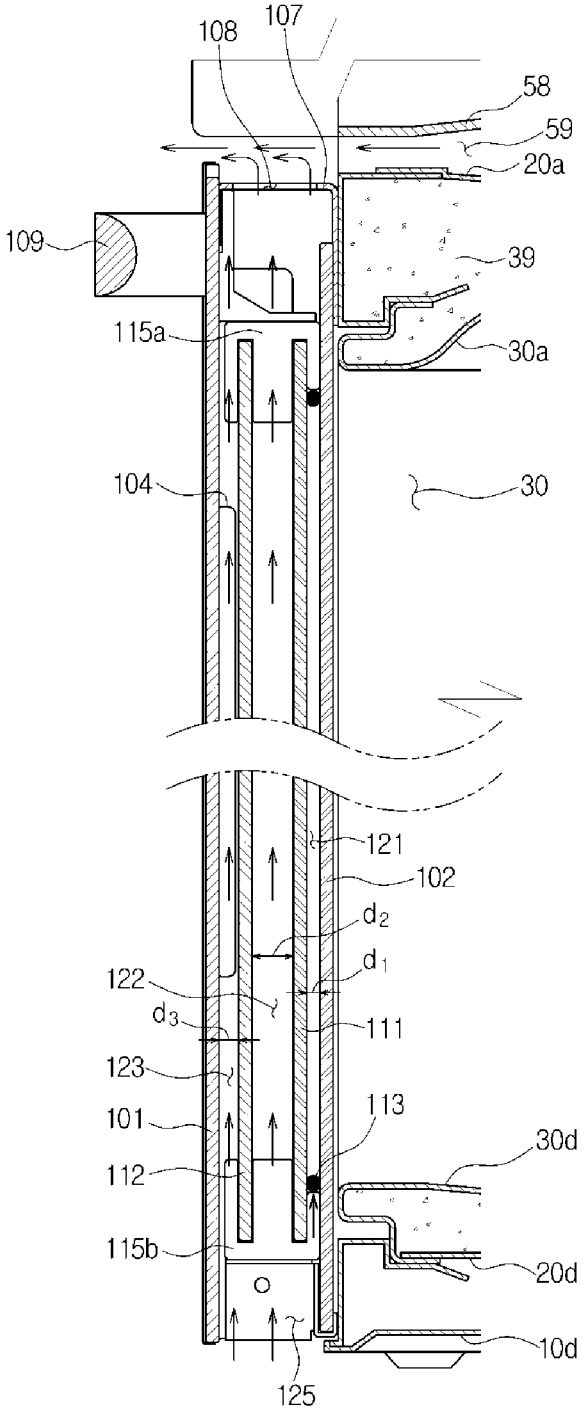
FIG. 5 is a side cross-sectional view of a door assembly, according to an embodiment of the present disclosure.

The door assembly 100 may include a bottom flow-in unit 125 (of FIG. 5). The bottom flow-in unit 125 may serve as a passage for outdoor air to flow in to the inside of the door assembly 100. For example, in the door assembly 100, the bottom flow-in unit 125 may be provided in a way that the bottom face of the door assembly 100 is open.

The door assembly 100 may further include a handle 109. The handle 109 may be installed on the front side of the door assembly 100. The handle 109 may be provided in a way that protrudes forward from the front side of the door assembly 100.

FIG. 5 is a side cross-sectional view of a door assembly, according to an embodiment of the present disclosure.

Referring to FIGS. 2 to 5, the door assembly 100 may further include a first inner plate 111. The first inner plate 111 may divide the inner space of the door assembly 100. The first inner plate 111 may be arranged in the inner space at a position to face the rear side of the door assembly 100. The first inner plate 111 may be positioned in parallel with the rear plate 102. At least a part of the first inner plate 111 may include a transparent material, such as glass.

The first inner plate 111 may form a first fluid path 121 with the rear plate 102. The first fluid path 121 may be formed at a position to face the rear plate 102 of the door assembly 100, and provide a space for air movement from the bottom toward the top. The first fluid path 121 may have a first distance d1 between the first inner plate 111 and the rear plate 102.

The door assembly 100 may further include a second inner plate 112. The second inner plate 112 may be arranged in the inner space of the door assembly 100 to be positioned between the first inner plate 111 and the front plate 101. The second inner plate 112 may divide a space between the first inner plate 111 and the front side of the door assembly 100. The second inner plate 112 may be provided in parallel with the first inner plate 111. At least a part of the second inner plate 112 may include a transparent material, such as glass.

The second inner plate 112 may form a second fluid path 122 with the first inner plate 111. The second fluid path 122 may be formed separately from the first fluid path 121 before the first fluid path 121. The second fluid path 122 may provide a space for air to move from the bottom toward the top. The second fluid path 122 may have a second distance d2 between the first inner plate 111 and the second inner plate 112.

Furthermore, the second inner plate 112 may form a third fluid path with the front plate 101. The third fluid path 123 may be formed separately from the second fluid path 122 before the second fluid path 122. The third fluid path 123 may have a third distance d3 between the second inner plate 112 and the front plate 101.

For example, the first distance d1 of the first fluid path 121 may be narrower than the second distance d2 of the second fluid path 122. Further, the first distance d1 of the first fluid path 121 may be narrower than the third distance d3 of the third fluid path 123.

The second distance d2 of the second fluid path 122 may be wider than the first distance d1 of the first fluid path 121 and the third distance d3 of the third fluid path d3.

The third distance d3 of the third fluid path 123 may be wider than the first distance d1 of the first fluid path 121. The third distance d3 of the third fluid path 123 may also be narrower than the second distance d2 of the second fluid path 122.

The door assembly 100 may further include a holder 115. The holder 115 may fasten the first and second inner plates 111 and 112 to the inside of the door assembly 100. The holder 115 may include an upper holder 115*a* and a lower holder 115*b*.

The upper holder 115*a* may be installed on both sides of the bottom of the top cover 107. The upper holder 115*a* may hold the respective upper parts of the first and second inner plates 111 and 112 to get them fixed.

The lower holder 115*b* may be installed on the respective bottom of the first and second side frames 103*a* and 103*b*. The lower holder 115*b* may hold the respective lower parts of the first and second inner plates 111 and 112 to get them fixed.

Figure 6:
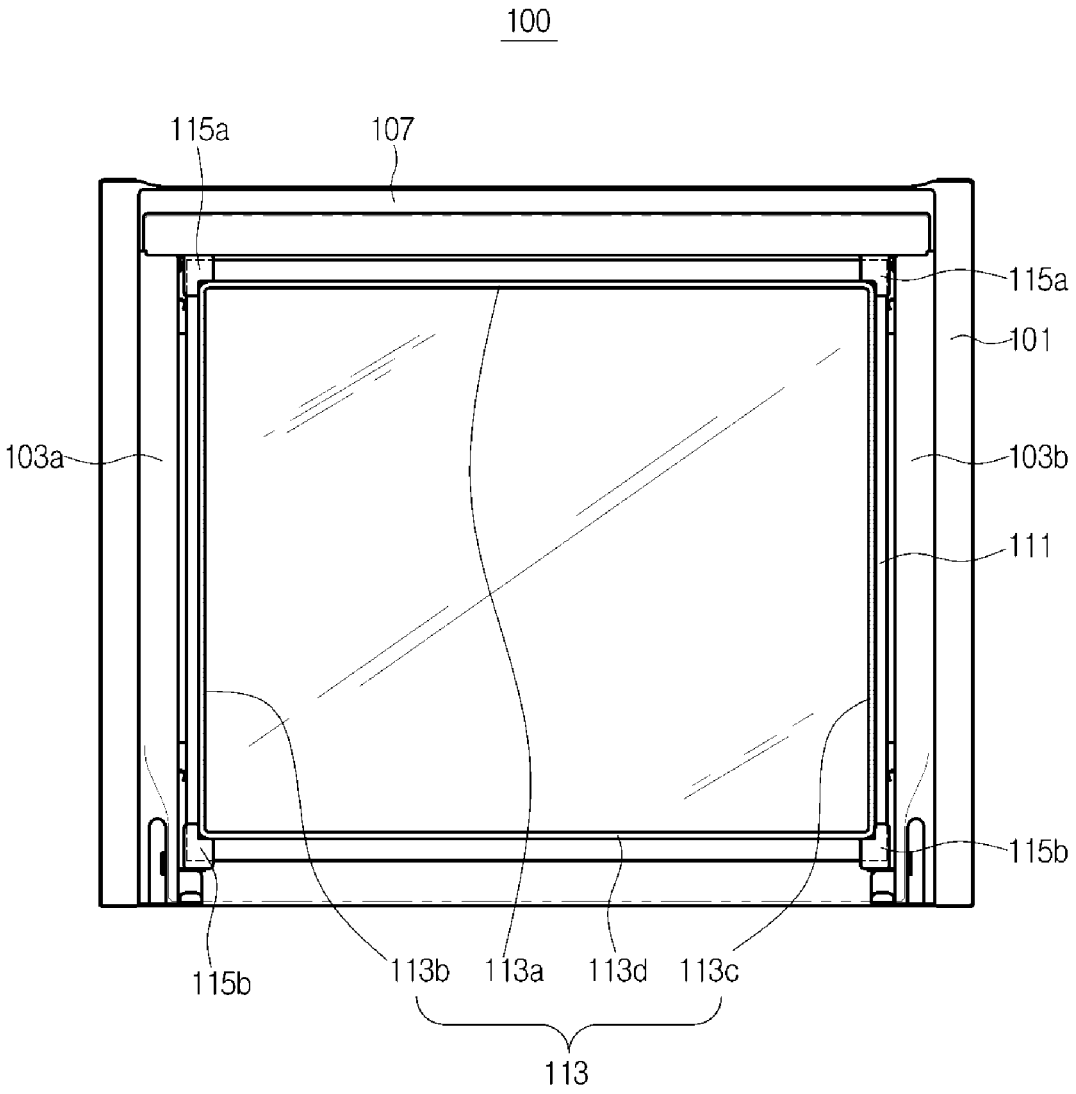
FIG. 6 shows a shielding member combined on the inner side of a door assembly, according to an embodiment of the present disclosure.

FIG. 6 shows a shielding member combined on the inner side of a door assembly, according to an embodiment of the present disclosure.

Referring to FIGS. 4 to 6, the door assembly 100 in accordance with an embodiment of the present disclosure may further include a shielding member 113.

The shielding member 113 may be positioned between the first inner plate 111 and the rear side of the door assembly 100. The shielding member 113 may block outdoor air from flowing in between the first inner plate 111 and the rear side of the door assembly 100. The shielding member 113 may be in the first fluid path 121 to block circulation of the air in the first fluid path 121.

As shown in FIG. 6, the shielding member 113 may be formed to have a rectangular shape. The shielding member 113 may be formed to run along edges of the first inner plate 111. The shielding member 113 may be formed in a way that surrounds edges of a space formed between the first inner plate 111 and the rear side of the door assembly 100. The shielding member 113 may be formed to have a rectangular shape in order to shield all of the top, bottom, and both sides of the first fluid path 121. For this, the shielding member 113 may be provided to extend to contact the four holders 115 located in the first fluid path 121. Although not shown, the four holders may each have a fastener to hold and fix the shielding member 113.

The shielding member 113 may shield all of the top, bottom, and both sides of the first fluid path 121. Specifically, the shielding member 113*d* may shield the bottom of the first fluid path 121 to block the air flowing in from the open bottom of the door assembly from moving into the first fluid path 121. The shielding member 113*b*, 113*c* may also shield the both sides of the first fluid path 121 to block the air flowing into the door assembly 100 through the side flow-in unit 104 from moving into the first fluid path 121. Furthermore, the shielding member 113*a* may shield the top of the first fluid path 121 to block the air inside the first fluid path 121 from moving out of the door assembly 100.

Figure 7:
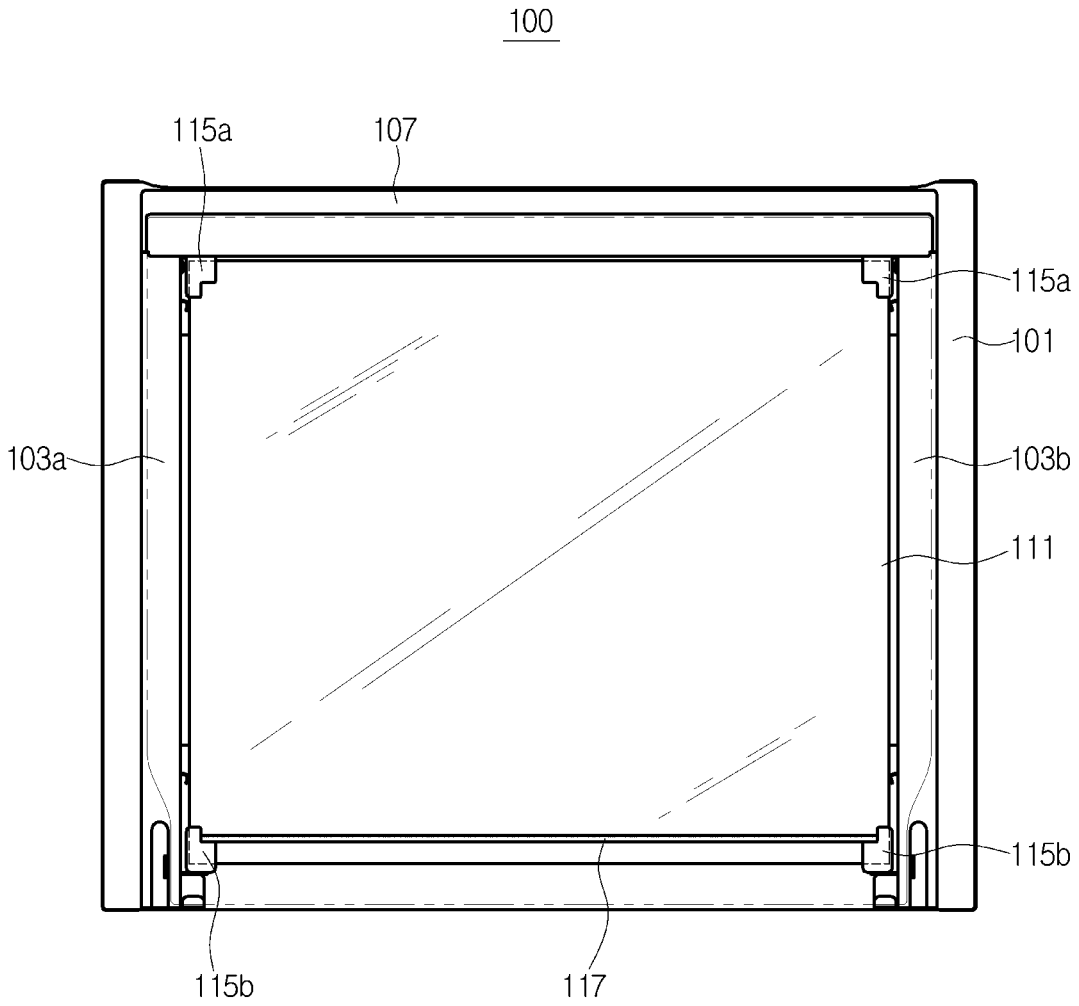
FIG. 7 shows a modified example of the shielding member of FIG. 6.

FIG. 7 shows a modified example of the shielding member of FIG. 6.

Referring to FIG. 7, a shielding member 117 may be formed to extend along the bottom side of the first inner plate 111 in a space between the first inner plate 111 and the rear side of the door assembly 100. The shielding member 117 may be positioned to shield the bottom of the first fluid path 121. The shielding member 117 may be formed to extend from the lower folder 115*b* on one side of the first fluid path 121 to the lower folder 115*b* on the other side. With this, the shielding member 117 may block the air flowing in from the open bottom of the door assembly from moving into the first fluid path 121.

Figure 8:
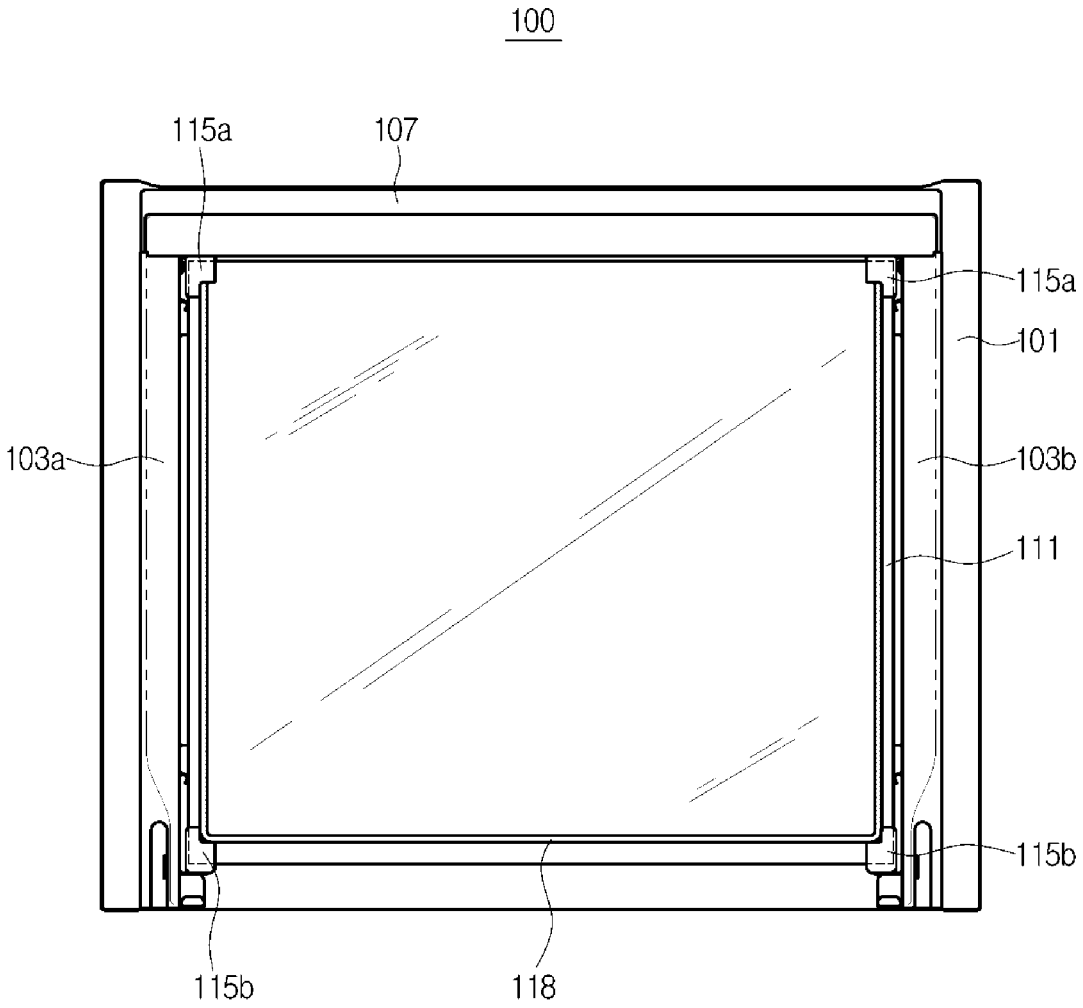
FIG. 8 shows a modified example of the shielding member of FIG. 6.

FIG. 8 shows a modified example of the shielding member of FIG. 6.

Referring to FIG. 8, a shielding member 118 may be formed to extend along the bottom and both sides of the first inner plate 111 in a space between the first inner plate 111 and the rear side of the door assembly 100. As compared to the shielding member 113 of FIG. 6, the shielding member 118 has a difference in that it may have an open top. The shielding member 118 may be positioned to shield the bottom and both sides of the first fluid path 121. The shielding member 118 may be provided in the form of connecting the upper and lower holders 115*a* and 115*b* that face each other and connecting the lower holders 115*b* on both sides. With this, the shielding member 118 may block the air flowing in from the open bottom of the door assembly 100 or through the side flow-in unit 104 from moving into the first fluid path 121.

In case of cleaning of the cooking room 30 during or after a cooking process, the oven 1 may often keep the inside of the cooking room 30 at a high temperature. Insulation 39 may be provided between the cooking room 30 and the panel 20 on all the sides of the cooking room 30 except for its open front for shielding heat of the cooking room 30. However, the insulation 39 may not be provided for the door assembly 100 located on the front of the cooking room 30, in order for outdoor air to circulate in the inner space.

Specifically, the outdoor air flowing into the inner space of the door assembly 100 through the bottom flow-in unit 125 may move out of the door assembly 100 through the flow-out hole 108. The temperature of the air inside the door assembly 100 rises due to heat exchange with the heated door assembly 100. The air of high temperature may move upward along the inner space of the door assembly 100, and then move outside of the door assembly 100 through the flow-out hole 108. The air moving outside of the door assembly 100 through the flow-out hole 108 may move out of the oven 1 with the air discharged forward of the oven 1 through the cooling fan fluid path 59. If the air moves out through the flow-out hole 108, outdoor air may flow into the inner space of the door assembly 100 through the bottom flow-in unit 125. With this process, the temperature of the front side of the door assembly 100 may be dropped.

It may also lead to a drop in temperature of the rear side of the door assembly 100. However, in a case of cleaning the cooking room 30 to remove foreign materials stuck to the inner wall of the cooking room 30 and the rear side of the door assembly 100 by using high temperatures of the cooking room 30, the drop in temperature of the rear side of the door assembly 100 may lead to a decrease of the cleaning efficiency.

To solve this, in an embodiment of the present disclosure, the plurality of fluid paths 121, 122, 123 may be formed in the inner space of the door assembly 100, and among them, the first fluid path 121 may be provided with the shielding member 113 to block air circulation in the first fluid path 121. Accordingly, outdoor air flowing in through the bottom flow-in unit 125 may move along the second and third fluid paths 122 and 123 to the flow-out hole 108 on the top, and then move outside of the door assembly 100 through the flow-out hole 108. Heat exchange may occur by continuous circulation of the outdoor air through the second and third fluid paths 122 and 123. This may result in a larger drop in the temperature of the front plate 101, top cover 107, and side frame 103 of the door assembly 100, which are located close to the second and third fluid paths 122 and 123, than that of the rear plate 102.

As for the rear plate 102 of the door assembly 100 with the structure as discussed above, since air circulation in the first fluid path 121 is blocked, the temperature inside the cooking room 30 may remain the same. Even as for an attempt of cleaning the inner side of the rear plate 102 of the door assembly 100 by using high temperatures inside the cooking room 30, the inner side of the rear plate 102 may be cleaned as same as the inner wall of the cooking room 30.

As described above, in accordance with an embodiment of the present disclosure, the inner side of the rear plate 102 of the door assembly 100 may maintain the same temperature inside the cooking room 30, while the front plate 101, top cover 107, and side frame 103 of the door assembly 100 may be cooled off by circulation of the outdoor air to a user-contactable temperature. This may improve the efficiency of cleaning the inside of the cooking room 30 and the rear plate 102 of the door assembly 100.

Figure 9:
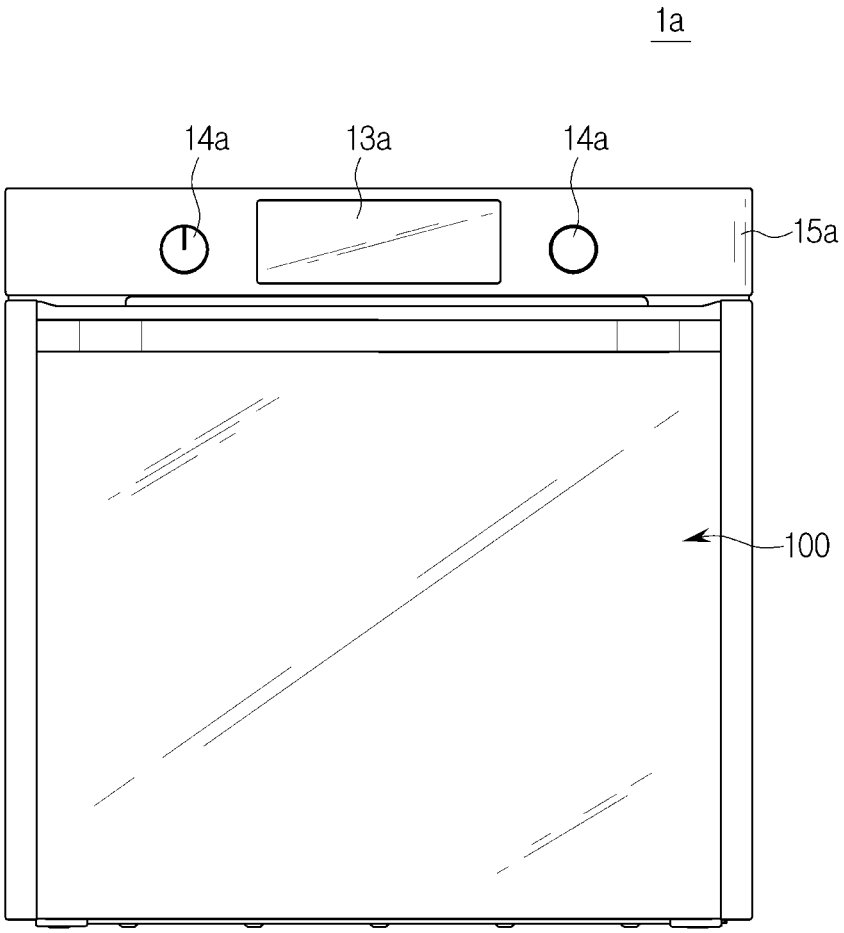
FIG. 9 is a front view of an oven, according to an embodiment of the present disclosure.
Figure 10:
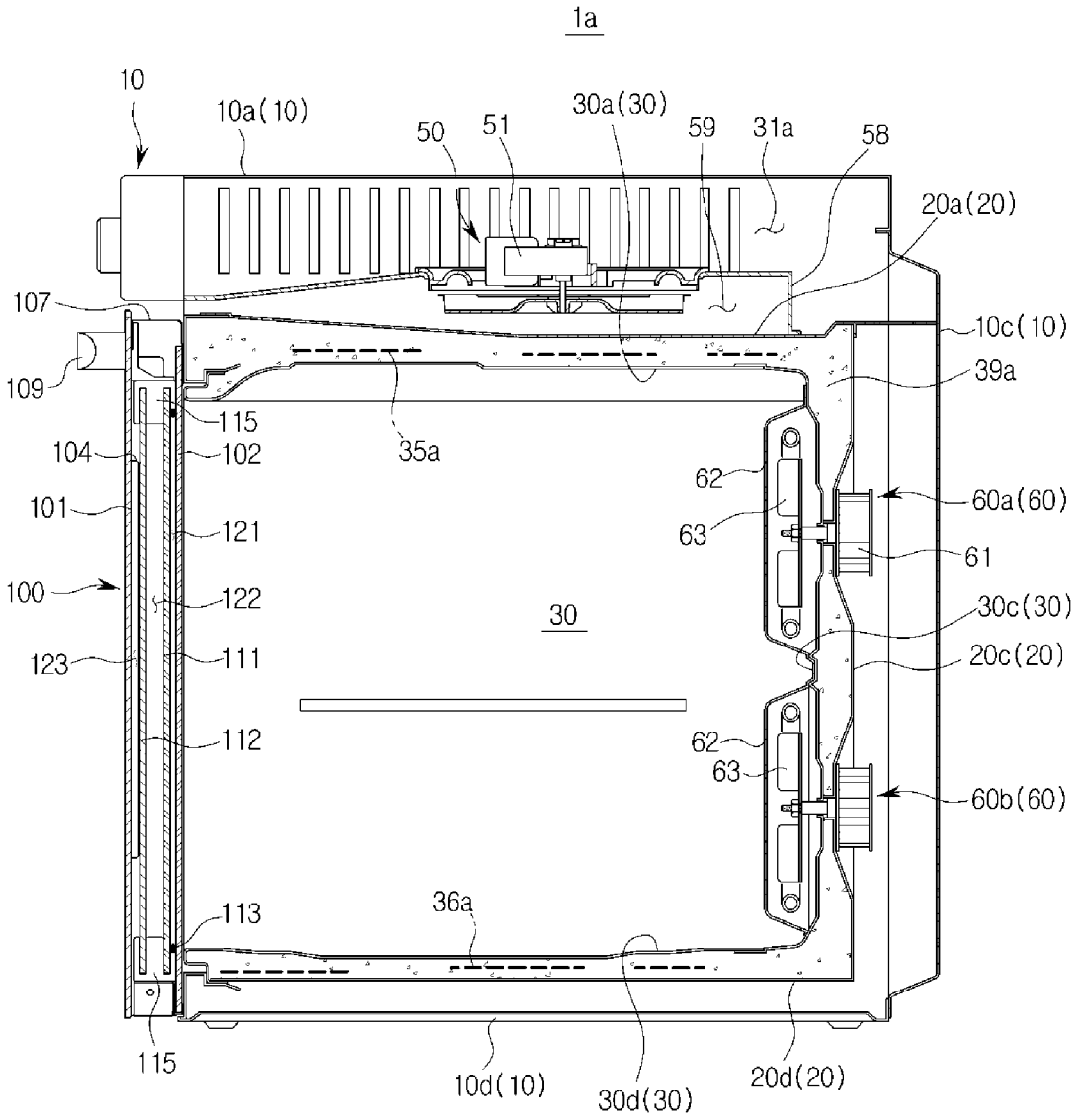
FIG. 10 is a side cross-sectional view of an oven, according to an embodiment of the present disclosure.

FIG. 9 is a front view of an oven, according to an embodiment of the present disclosure, and FIG. 10 is a side cross-sectional view of an oven, according to an embodiment of the present disclosure.

As shown in FIGS. 9 and 10, an oven may include a casing that forms the exterior, and a cooking room located inside the casing. The structure of the casing and cooking room of FIGS. 9 and 10 are substantially the same as that as described in connection with FIGS. 1 to 3, so the following description will focus on the difference between them.

Referring to FIGS. 9 and 10, a first heating source may be installed between the top casing and the cooking room top plate, and a second heating source may be installed between the bottom casing and the cooking room bottom plate. The first and second heating sources may each have a structure for supplying heat into the cooking room by being controlled to be on or off according to the cooking mode.

A machine room 31*a* containing various mechanical and electrical parts such as circuit boards (not shown) is arranged on top of the cooking room. A control panel of the machine room may include a display for displaying information about many different operations of the oven, and a controlling unit for controlling the operation of the oven. The controlling unit may use a pressure switch or a touch pad, and the display may use a Liquid Display Panel (LDP).

Although the control panel in accordance with an embodiment has the controlling unit and the display separately, arrangement of the control panel and display may not be limited thereto, but a touch screen panel (TSP) having the controlling unit and the display integrated therein may be used.

Detailed description that overlaps what are described in connection with FIGS. 1 to 3 will be omitted herein.

Figure 11:
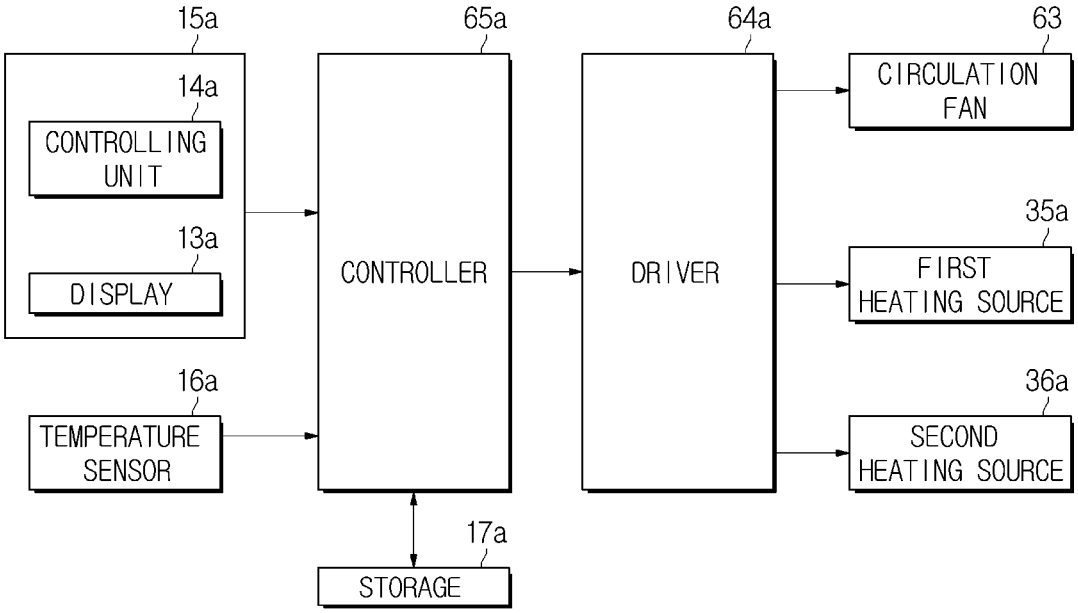
FIG. 11 is a control block diagram of an oven, according to an embodiment of the present disclosure.

FIG. 11 is a control block diagram of an oven, according to an embodiment of the present disclosure.

Referring to FIG. 11, the oven may include a control panel 15*a*, a temperature sensor 16*a*, a storage 17*a*, a driver 64*a*, a circulation fan 63, a first heating source 35*a*, a second heating source 36*a*, and a controller 65*a*.

As described above, the control panel 15*a* may include the controlling unit 14*a* for receiving various instructions for operations of the oven, and the display 13*a* for displaying operation information of the oven for the user.

In an embodiment, the controlling unit 14*a* may include a cooking mode controlling unit for receiving information regarding a cooking mode of the oven, and a cleaning mode controlling unit for receiving information regarding a cleaning mode of the oven. In an embodiment, the display 13*a* may display an operation of the heat source as a predetermined graphic image in response to an operation instruction of the oven input through the controlling unit 14*a*, or display a change in temperature of the cooking room due to operation of the heat source as a predetermined change in color.

The temperature sensor 16*a* may be installed inside the cooking room for detecting temperatures in the cooking room that change according to operations of the oven. The temperature sensor 16*a* may be installed on at least one of the cooking room top plate, bottom plate, either side plate, and back plate, for periodically detecting temperature in the cooking room that changes according to operations of the oven.

The temperature detected in the cooking room by the temperature sensor 16*a* may be informed to the controller, which may in turn control a graphic image to be displayed on the display 13*a* based on the temperature information collected from the temperature sensor 16*a*. Detection of temperature which is performed by the temperature sensor 16*a*, and associated operation of the controller 65*a* will be described later.

The temperature sensor 16*a* may be implemented with a contact temperature sensor, or a contactless temperature sensor. Specifically, the temperature sensor 16*a* may be implemented with at least one of a resistance thermometer detector (RTD) temperature sensor that uses changes in metal resistance due to changes in temperature, a thermistor temperature sensor that uses changes in semiconductor resistance due to changes in temperature, a thermo couple temperature sensor that uses electromotive forces produced at both terminals of a junction of two kinds of metal wires formed of different materials, and an Integrated Circuit (IC) temperature sensor that uses current-voltage characteristics of a P-N junction. However, the temperature sensor is not limited thereto, but may also be implemented with another type of temperature sensor able to detect temperature inside the cooking room.

The storage 17*a* may store various data, programs, or applications for operating and controlling the oven. For example, the storage 17*a* may store data about a detection cycle of the temperature sensor 16*a*, operating temperature and time of e.g., the first and second heating sources in a cooking mode, revolutions per minute (RPM) of the circulation fan 63, etc., a control program for controlling the oven, dedicated applications provided by the manufacturer by default, or universal applications downloaded from outside.

The storage 17*a* may be implemented with volatile memory devices, such as Read Only Memory (ROM), Programmable Read Only Memory (PROM), Erasable Programmable Read Only Memory (EPROM), and flash memory, non-volatile memory devices, such as Random Access Memory (RAM), hard disks or optical disks.

The driver 64*a* may output driving signals to respective components of the oven. The driver 64*a* may include a circulation motor to circulate the circulation fan 63.

The controller 65*a* may control general operation of the oven and signal flows among the components of the oven, and process data. The controller 65*a* may run an operating system (OS) and various applications stored in the storage 17*a* when the user's input or a predetermined condition is met.

The controller 65*a* may control the first and second heating sources, and the circulation fan 63 to cook the food contained in the oven when the user selects a cooking mode of the oven, and to clean the inside of the oven when the user selects a cleaning mode of the oven. Operation of the controller 65*a* in a cooking mode will now be described.

The controller 65*a* may control operations of e.g., the first and second heating sources and the circulation fan 63 in a cooking mode to be displayed as predetermined graphic images through the display 13*a*. The form of the graphic image may vary, and the variation of the form of the graphic images may be used to display information about thermal diffusion inside the oven as well.

For example, in a cooking mode for cooking food only by heat supplied from the first heating source 35*a*, a graphic image corresponding to the first heating source 35*a* may be displayed on the display 13*a*. In this case, the controller 65*a* may display heat supplied from the first heating source 35*a* being diffused inside the oven, by controlling the image corresponding to the first heating source 35*a* to be displayed as being expanded.

The controller 65*a* may control a change in temperature of the cooking room due to operation of the first and second heating sources 35*a*, 36*a* and the circulation fan 63 to be displayed on the display 13*a* as a predetermined change in color. More specifically, the change in temperature in the cooking room may be displayed as a change in color of the graphic image displayed on the display 13*a*.

For example, in the cooking mode for cooking food only by heat supplied from the first heating source 35*a*, the temperature inside the oven may rise while the heat is being supplied from the first heating source 35*a*. The controller 65*a* may then detect the temperature in the oven using information about the temperature detected by the temperature sensor 16*a* in the oven, and may display the temperature rise in the oven as a change in color of the graphic image when determining that the temperature in the oven is rising.

FIGS. 12 to 15 illustrate operation of a heat source and thermal diffusion in cooking mode visualized on a display. In the other modes including a cleaning mode, similar illustration of what are displayed on the display in FIGS. 12 to 17 may be applied. In the following description, what are displayed in a cooking mode, for example, will be described.

The oven may include many different cooking modes. For example, the cooking modes may include convection mode in which the circulation fan operates, top/convection mode in which the first heating source and the circulation fan operate, bottom/convection mode in which the second heating source and the circulation fan operate, large grill mode in which the first heating source operates, convention mode in which the first and second heating sources operate, and bottom mode in which the second heating source operates, but are not limited thereto.

Figure 12:
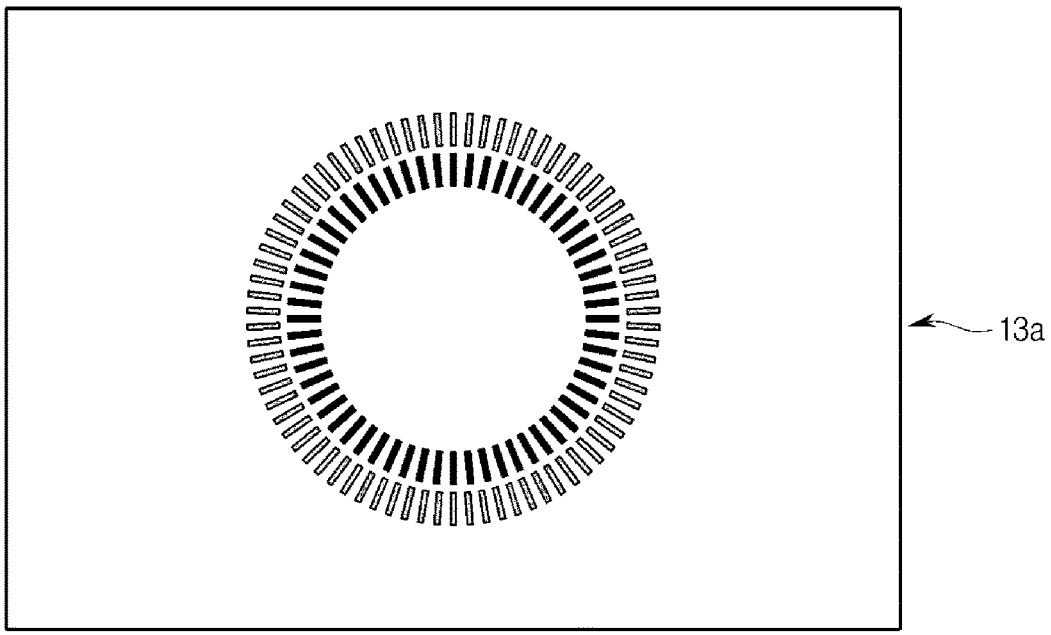
FIGS. 12 to 15 illustrate operation of a heat source and thermal diffusion in cooking mode visualized on a display.
Figure 13:
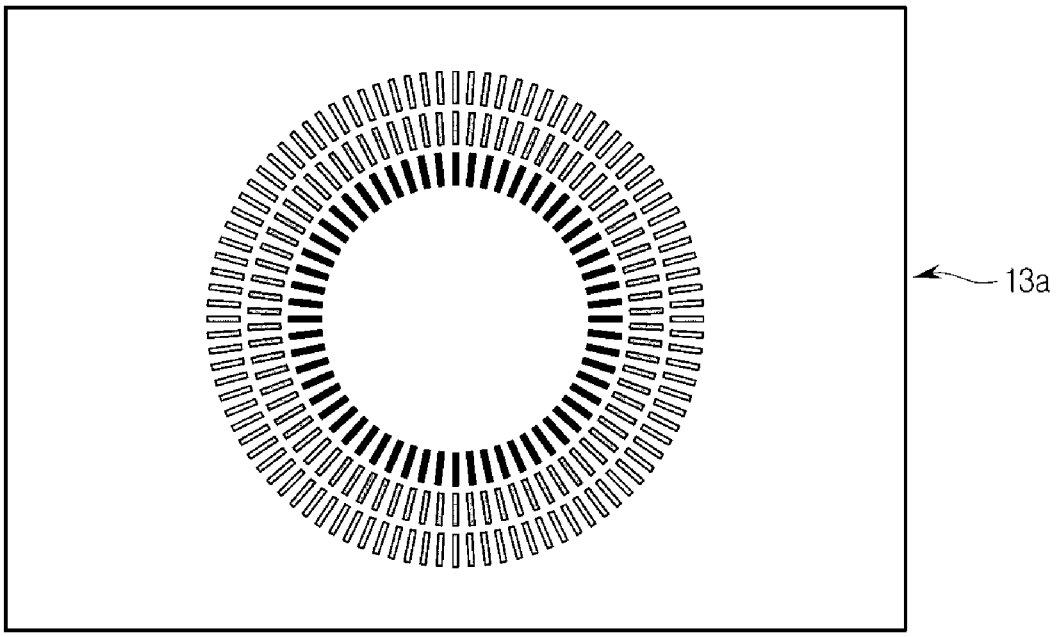

FIG. 12 illustrates operation of the circulation fan in the convection mode, visualized on the display, and FIG. 13 illustrates thermal diffusion due to the operation of the circulation fan in the convection mode, which is visualized on the display.

As shown in FIG. 12, the operation of the circulation fan may be displayed as a graphic image in a donut shape. In the early stages of the operation of the circulation fan, the operation of the circulation fan may be displayed as a single graphic image as shown in FIG. 12, and thermal diffusion that occurs as the operation of the circulation fan continues may be displayed as a form in which several graphic images of the donut form overlap each other. The operation of the heating source and the thermal diffusion are not exclusively displayed as in FIGS. 12 and 13, but may be displayed as a graphic image of a circular form or in other various forms including expansion and reduction of the graphic image.

Figure 14:
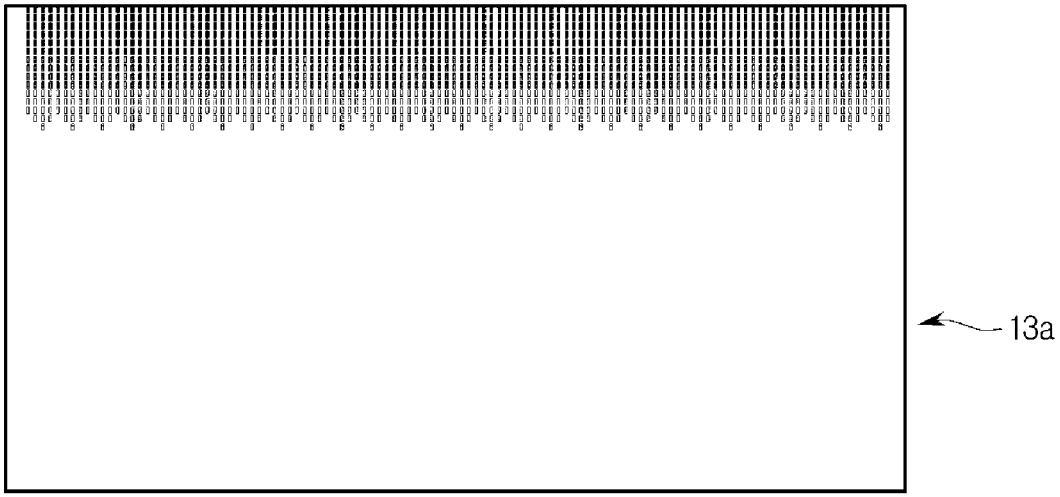
Figure 15:
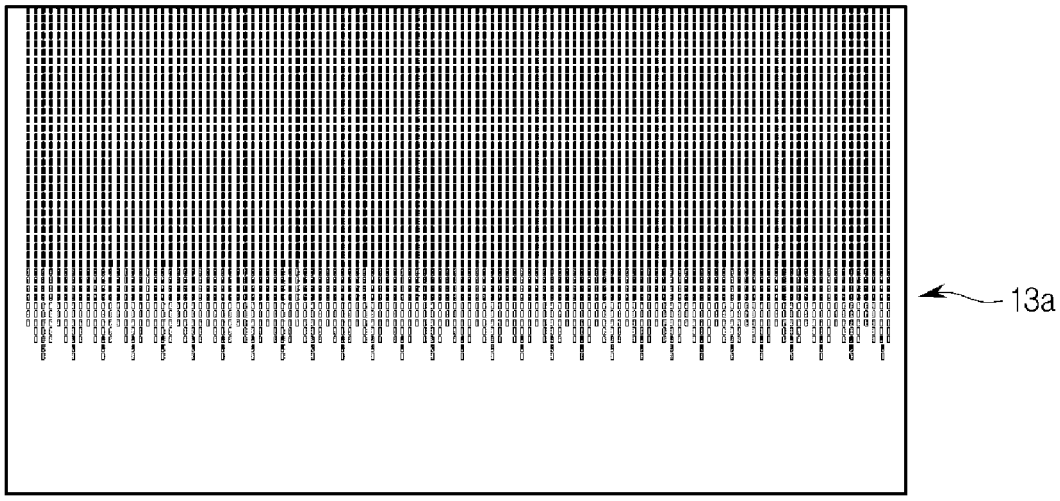

FIG. 14 illustrates operation of the first heating source in the large grill mode, which is visualized on the display, and FIG. 15 illustrates thermal diffusion due to the operation of the first heating source in the large grill mode, which is visualized on the display.

As shown in FIG. 14, the operation of the first heating source may be displayed such that a graphic image corresponding to the first heating source is placed in the upper part of the display. The graphic image corresponding to the first heating source may include gradation of the graphic image, but is not limited thereto.

In the early stages of operation of the first heating source, the operation of the first heating source may be displayed as a narrow range of graphic image, as shown in FIG. 14, and the thermal diffusion that occurs as the operation of the first heating source continues may be displayed as a wider range of graphic image, as shown in FIG. 15.

Although not shown, in the top/convection mode in which the first heating source and the circulation fan operate, a graphic image of a combined form of graphic images shown in FIGS. 12 to 15 may be displayed. In the bottom/convection mode in which the second heating source and the circulation fan operate, a graphic image of a combined form of the graphic images shown in FIGS. 12 and 13 and the graphic image placed in the lower part of the display may be displayed. In the convention mode in which the first and second heating sources operate, a graphic image of a combined form of the graphic images shown in FIGS. 14 and 15 and the graphic image placed in the lower part of the display may be displayed. In the bottom mode in which the second heating source operates, the graphic image placed in the lower part of the display may be displayed. The graphic image placed in the lower part of the display may have the same form as that of the graphic images shown in FIGS. 14 and 15, i.e., the graphic image placed in the lower part of the display may have the form of gradation and placed in the lower part of the display.

Figure 16:
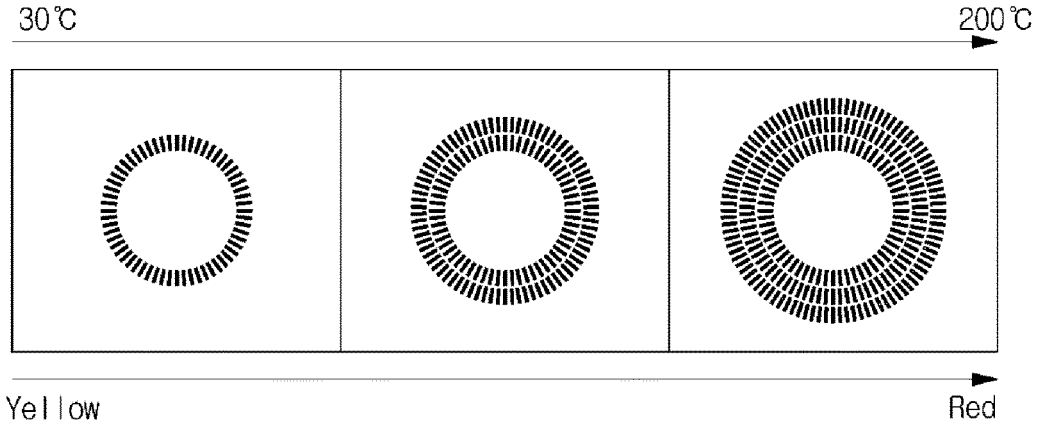
FIG. 16 illustrates operation of a heat source and the rising of temperature in the oven room, visualized on a display.

FIG. 16 illustrates operation of a heat source and the rising of temperature in the oven, visualized on the display. More specifically, given that food is being cooked at about 200° C. in the convection mode, displaying the rising of temperature in the oven and the thermal diffusion process on the display is illustrated.

For example, temperatures in the oven may be kept at about 30° C. in the early stages of operation of the oven, and may rise to about 200° C. over time, due to hot air supplied from the circulation fan. In this case, the display may display a graphic image in yellow-color series at about 30° C. and red-color series at about 200° C. by reflecting the change in temperature in the oven, as shown in FIG. 16. However, color implementations are not limited to what are illustrated in FIG. 16, but may include other various modifications that may be easily practiced by one of ordinary skill in the art.

As the temperature in the oven rises from 30° C. to 200° C., thermal diffusion in the oven may also occur. In this case, as shown in FIG. 16, a form in which several graphic images of the donut shape overlap each other may be displayed on the display to visualize the thermal diffusion in the oven.

Figure 17:
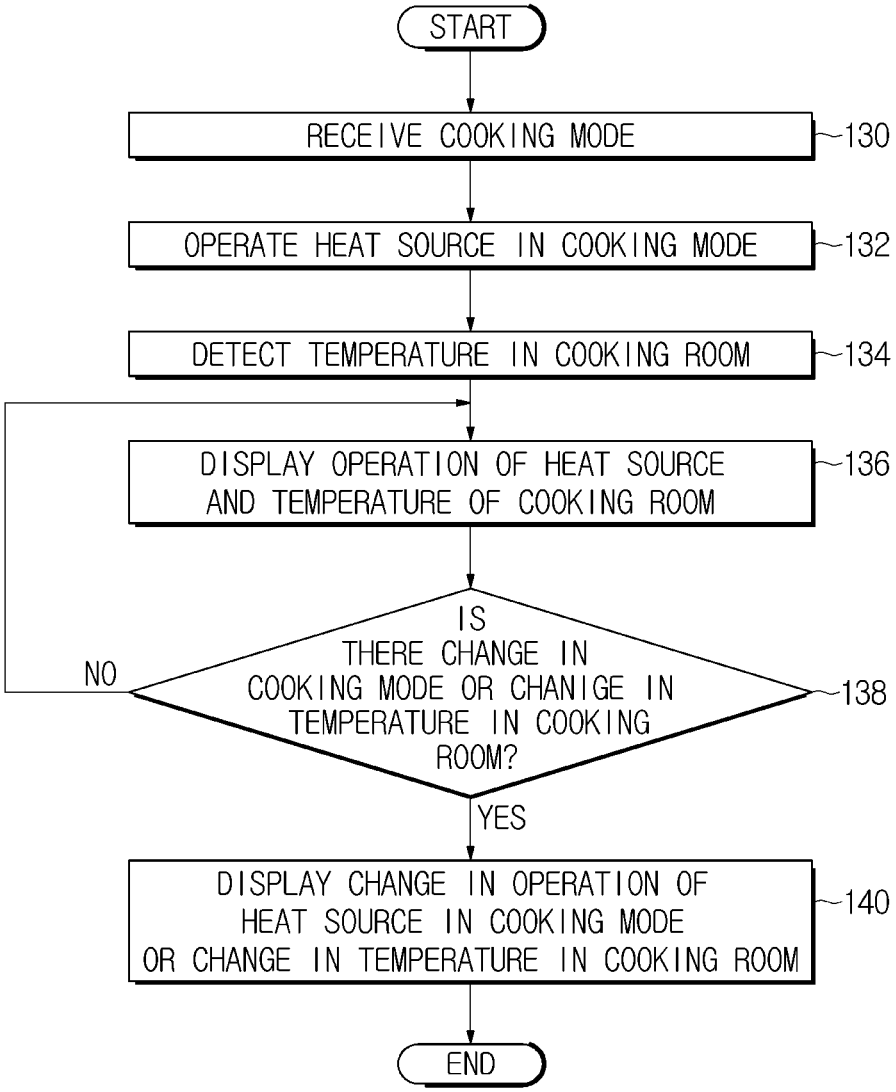
FIG. 17 is a flowchart illustrating a method for controlling an oven, according to an embodiment of the present disclosure.

FIG. 17 is a flowchart illustrating a method for controlling an oven, according to an embodiment of the present disclosure. The oven may be separately controlled in respective modes, but in the following description, a control process of the oven will be focused on a cooking mode.

Referring to FIG. 17, a method for controlling the oven may include receiving a cooking mode (operation 130), controlling a heat source to operate according to the cooking mode (operation 132), detecting a temperature in the cooking room (operation 134), displaying operation of the thermal source and the temperature of the cooking room (operation 136), and displaying a change in operation of the heat source or a change in temperature of the cooking room in the cooking mode (operations 138 and 140).

First, upon reception of a cooking mode, a series of operations are performed.

Specifically, heat source may operate in the cooking mode. For example, if the convection mode is input, a circulation fan may be rotated.

Once the heat source starts to operate, a temperature sensor arranged in the oven may detect a temperature in the cooking room. The temperature sensor may periodically detect temperatures in the cooking room, and output the detection result to the controller.

Next, a display may display the temperature in the cooking room and the operation of the heat source. The heat source as herein used may include the first and second heating units and the circulation fan, as described above, and the form of the graphic image may be determined depending on initially input mode.

For example, in the convection mode, a graphic image corresponding to the operation of the circulation fan may be displayed and the graphic image may come in a color that corresponds to the temperature in the cooking room.

According to one or more embodiments of the present disclosure, cleaning efficiency of the inside of a cooking room of an oven and the inner side of a door of the oven may be improved.

A door assembly with an improved structure in accordance with one or more embodiments of the present disclosure may cool off the outer side of the door assembly while keeping the inner side of the door assembly at the same temperature of the inside of the cooking room.

Accordingly, the inner wall of the cooking room and the inner side of the door may be efficiently cleaned by using high temperatures.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. An oven comprising:

a casing;

a cooking room located inside the casing and having an open front; and a door assembly mounted to the cooking room to open and close the open front of the cooking room, wherein the door assembly has an inner space and the door assembly comprises:

a rear plate and a front plate to form the inner space of the door assembly;

a first inner plate installed in the inner space to divide the inner space;

a shielding member located between the first inner plate and the rear plate of the door assembly to block air circulation between the first inner plate and the rear plate; and a second inner plate located between the first inner plate and the front plate of the door assembly to divide a space between the first inner plate and the front plate of the door assembly, wherein a distance between the first inner plate and the second inner plate is wider than a distance between the first inner plate and the rear plate of the door assembly, and wherein the distance between the first inner plate and the rear plate of the door assembly is narrower than a distance between the second inner plate and the front plate of the door assembly.

2. The oven of claim 1, wherein:

the first inner plate is arranged in a position to face the rear plate of the door assembly, and a distance between the first inner plate and the rear plate of the door assembly is narrower than a distance between the first inner plate and the front plate of the door assembly.

3. The oven of claim 1, wherein the front plate, the rear plate, the first inner plate and the second inner plate of the door assembly each have at least a part formed of a glass of a transparent material.

4. The oven of claim 1, wherein the shielding member is arranged to extend along a bottom of the first inner plate to block outdoor air from flowing between the first inner plate and the rear plate of the door assembly.

5. The oven of claim 1, wherein the shielding member is arranged in a form of surrounding edges of a space formed between the first inner plate and the rear plate of the door assembly.

6. The oven of claim 1, wherein the door assembly has an open bottom and a flow-out hole arranged on one side of a top of the door assembly.

7. The oven of claim 6, further comprising:

a cooling fan unit including a cooling fan located between the casing and a top of the cooking room; and a cooling fan fluid path that runs from the cooling fan to a front of the oven, wherein the flow-out hole is arranged in a position to face the cooling fan fluid path.

8. An oven having a heat cleaning mode for cleaning an inner wall of a cooking room and an inner side of a door assembly facing the cooking room by using high temperatures, the oven comprising:

a casing;

a cooking room located inside the casing and having an open front; and a door assembly having at least one fluid path formed therein and the door assembly mounted to the cooking room to open and close the open front of the cooking room, wherein the door assembly comprises:

a front plate;

a rear plate;

a first fluid path formed along the rear plate of the door assembly to provide a space; and a shielding member installed inside the first fluid path for blocking air circulation in the first fluid path;

a second fluid path which is formed separately from the first fluid path and which provides a space for air circulation; and a third fluid path which is formed along the front plate and which is formed separately from the second fluid path in order to provide a space for air circulation from the bottom toward the top, wherein the first fluid path is separated from the second fluid path by a first inner plate, wherein the first fluid path has a first width which is narrower than a second width of the second fluid path, and wherein the third fluid path has a third width which is wider than the first width of the first fluid path.

9. The oven of claim 8, wherein the shielding member is located on a lower side of the first fluid path for shielding the first fluid path.

10. The oven of claim 8, wherein the shielding member has a rectangular shape to shield the top, bottom, and both sides of the first fluid path.

11. The oven of claim 8, wherein the door assembly further comprises:

a second inner plate positioned between the first inner plate and the front plate for forming the second and third fluid paths, wherein the first inner plate forms the first fluid path with the rear plate of the door assembly, wherein the first inner plate forms the second fluid path with the second inner plate, and wherein the second inner plate forms the third fluid path with the front plate.

12. The oven of claim 11, wherein the front plate, the rear plate, the first inner plate and the second inner plate of the door assembly each have at least a part formed of a glass of a transparent material.

13. The oven of claim 8, wherein the door assembly enables air flowing into an inside of the door assembly through a bottom flow-in unit to move outside of the door assembly through a flow-out hole formed on one side of a top of the door assembly.

14. The oven of claim 13, further comprising:

a cooling fan unit including a cooling fan located between the casing and a top of the cooking room; and a cooling fan fluid path that runs from the cooling fan to a front of the oven, wherein the flow-out hole is arranged in a position to face the cooling fan fluid path.

15. A door assembly having an inner space and serving to open and close a cooking room of an oven, the door assembly comprising:

a first inner plate positioned in the inner space to face a rear plate of the door assembly and to divide the inner space; and a shielding member located between the first inner plate and the rear plate of the door assembly to block air circulation; and a second inner plate located between the first inner plate and a front plate of the door assembly to divide a space between the first inner plate and the front plate of the door assembly, wherein a distance between the first inner plate and the rear plate of the door assembly is narrower than a distance between the first inner plate and the front plate of the door assembly, and wherein a distance between the first inner plate and the second inner plate is wider than a distance between the first inner plate and the rear plate of the door assembly.

16. The door assembly of claim 15, wherein the shielding member extends along the bottom of the first inner plate to block outdoor air from flowing between the first inner plate and the rear plate of the door assembly.

17. The door assembly of claim 15, wherein the shielding member is arranged in a form of surrounding edges of a space formed between the first inner plate and the rear plate of the door assembly.

18. The door assembly of claim 15, wherein a distance between the second inner plate and the front plate of the door assembly is wider than the distance between the first inner plate and the rear plate of the door assembly.

19. The door assembly of claim 15, wherein a distance between the first inner plate and a second inner plate is wider than the distance between the second inner plate and the front plate of the door assembly.

20. The oven of claim 1, wherein the shielding member extends along both sides of the first inner plate and the bottom of the inner plate.

* * * * *